United States Patent [19]

De Lange et al.

[11] Patent Number: 4,559,956

[45] Date of Patent: Dec. 24, 1985

[54] METHOD OF AND APPARATUS FOR CURING TOBACCO

[75] Inventors: Jan H. De Lange, Hartebeesfrontein; Ernest Fick, Durban, both of South Africa

[73] Assignee: Modsa (Proprietary) Limited, Transvaal, South Africa

[21] Appl. No.: 470,032

[22] Filed: Feb. 28, 1983

[30] Foreign Application Priority Data

Mar. 29, 1982 [ZA] South Africa ..... 82/2108

[51] Int. Cl.[4] ..... A24B 3/12; A24B 3/04; A24B 1/02; A24B 3/02

[52] U.S. Cl. ..... 131/303; 131/299; 131/302; 432/500

[58] Field of Search ..... 131/299, 302, 303; 432/500

[56] References Cited

U.S. PATENT DOCUMENTS

| | | | |
|---|---|---|---|
| 1,339,374 | 2/1920 | Buensod | 131/303 |
| 2,798,496 | 7/1957 | Jones | 131/303 |
| 3,503,137 | 3/1970 | Wilson | 131/303 |
| 3,624,917 | 12/1971 | Moore | 131/303 |
| 4,192,323 | 3/1980 | Horne | 131/303 |
| 4,470,422 | 9/1984 | Joubert et al. | 131/302 |

*Primary Examiner*—V. Millin
*Assistant Examiner*—Gregory Beaucage

[57] ABSTRACT

In the curing of tobacco leaf in a curer heated air is circulated through the curer and controlled so that a first temperature is maintained in the curer for a given period of time. During this period the relative humidity level is reduced to a desired level. Thereafter a maximum predetermined temperature difference is maintained between upper and lower zones in the curer to dry the leaf.

5 Claims, 4 Drawing Figures

METHOD OF AND APPARATUS FOR CURING TOBACCO

BACKGROUND OF THE INVENTION

This invention relates to the curing of tobacco leaf.

The temperature and humidity in any type of tobacco curer must be properly controlled if the tobacco leaf is to be cured without spoilage in the minimum of time, with the best possible weight in cured leaf of the top quality. The curing process is dependent inter alia on the humidity and on the temperature inside the curer and on the nature of the leaf itself.

SUMMARY OF THE INVENTION

It is an object of the present invention to provide a method of curing tobacco leaf which takes account of the above mentioned factors.

The invention provides a method of curing tobacco leaf located in a curer which includes the steps of circulating an air stream through the curer, supplying heat to the air stream, controlling the circulation of the heated air stream so as to maintain a first temperature in the curer for a predetermined period, during the predetermined period reducing the relative humidity level prevailing in the curer from a first level to a second level, and, after the predetermined period, controlling the circulation of the heated air stream so as to maintain a predetermined temperature differential between upper and lower zones in the curer.

The circulation of the heated air stream may be controlled by varying the rate of flow of the circulating air stream, or the supply of heat to the air stream, or both.

The method further includes the step of interrupting the supply of heat to the air stream when the relative humidity level exceeds a predetermined level, and restoring the supply of heat to the air stream when the relative humidity level drops below the predetermined level.

The invention also extends to apparatus for controlling the curing of tobacco leaf located in a curer which includes means for circulating an air stream through the curer, means for supplying heat to the air stream, means for controlling the circulation of the heated air stream so as to maintain a first temperature in the curer for a predetermined period, means for reducing the relative humidity level prevailing in the curer from a first level to a second level during the predetermined period, and means for controlling the circulation of the heated air stream, after the predetermined period, so as to maintain a predetermined temperature differential between the upper and lower zones in the curer.

The means for maintaining the first temperature in the curer may include a dry bulb temperature sensor which is located in the air stream supplied to the curer. Preferably this means is located outside of an enclosure in which the leaf is, and controls the supply of heat to the air stream.

The means for reducing the relative humidity may include a wet bulb temperature sensor which is located in the enclosure and which varies the supply of the air stream or its circulation for example by means of vents, dampers or the like.

The means for maintaining the temperature differential may include upper and lower sensors located in upper and lower zones in the curer respectively.

The apparatus may include means which is responsive to the relative humidity level prevailing in the curer and which causes the supply of heat to the air stream to be interrupted if the relative humidity level exceeds a predetermined level. This means may include a wet bulb temperature sensor which preferably is the same sensor as is used in the means for reducing the relative humidity level.

The invention also provides a wet bulb temperature sensor which is located in a length of wick, the ends of the wick extending downwardly and being immersed in water the level of which is maintained slightly below the sensor.

BRIEF DESCRIPTION OF THE DRAWINGS

The invention is further described by way of example with reference to the accompanying drawings in which.

DESCRIPTION OF PREFERRED EMBODIMENT

Figure 1:
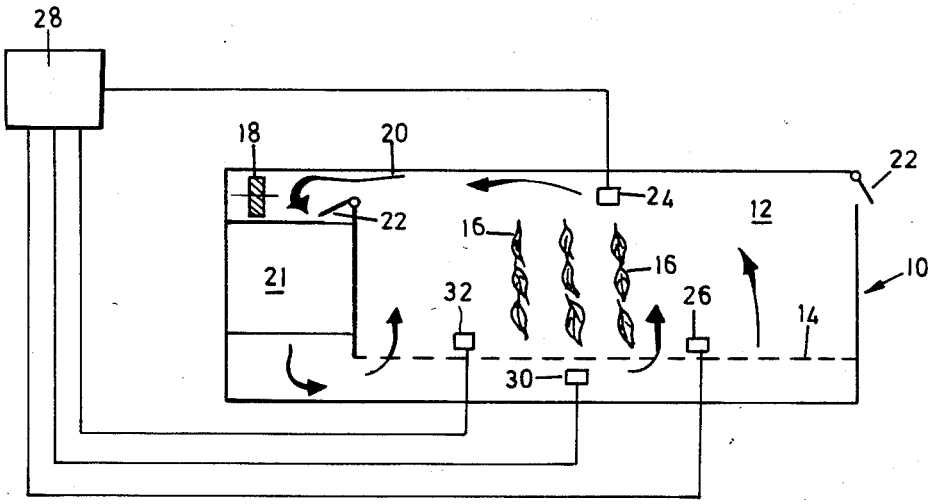
FIG. 1 is a schematic side view of a curer including curing apparatus according to the invention.

FIG. 1 illustrates a housing 10 which defines a curer 12 and which has a false floor 14.

The floor 14 is appertured and in use of the curer tobacco leaf 16 is tightly packed in frames inside the curer.

In use of the equipment air is circulated by means of a fan 18 through the curer and between the leaves in a direction indicated by means of the various arrows 20. The air passes through a heat exchanger 21 which is supplied with heat from a source, not shown, which may include an automatic stoker or burner.

The curer includes vents or dampers 22.

A temperature probe or sensor 24 is located in an upper zone inside the curer and a second temperature probe or sensor 26 is located in a lower zone inside the curer. These two probes generate electrical signals at amplitudes which are proportional to the respective temperatures in the zones and the electrical signals are applied to a controller 28.

A dry bulb sensor 30 is located in the air stream below the false floor 14 and a wet bulb temperature sensor 32 is located above the false floor.

Figure 2:
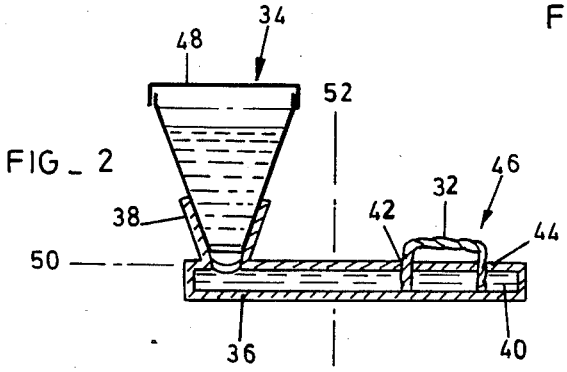
FIG. 2 is a sectional side view of a device which incudes a wet bulb sensor in accordance with the invention.

FIG. 2 illustrates a device 34 which is used with the wet bulb sensor 32. The device 34 includes a member 36 with a funnel-like formation 38 and a conduit portion 40 which extends from the formation 38 and which is sealed at its free end. Two holes 42 and 44 are formed through the upper wall of the conduit and the ends of a wick 46 extend downwardly through these holes. The active element of the wet bulb sensor 32 which may for example be a temperature dependent resistor, is located in the wick between the downwardly extending ends thereof.

A water container 48 which has the shape of an inverted funnel is located in the formation 38. The container 48 supplies water to the member 36 and maintains the water at a level 50 which corresponds more or less with the inner upper surface of the conduit 40. This ensures that the ends of the wick are at all times moistened and that the water does not escape by flowing directly through the holes 42 and 44. The water container 48 is located outside the enclosure in which the tobacco leaf 16 is situated and the conduit 40 extends through a wall of the curer represented by a dotted line 52.

Figure 3:
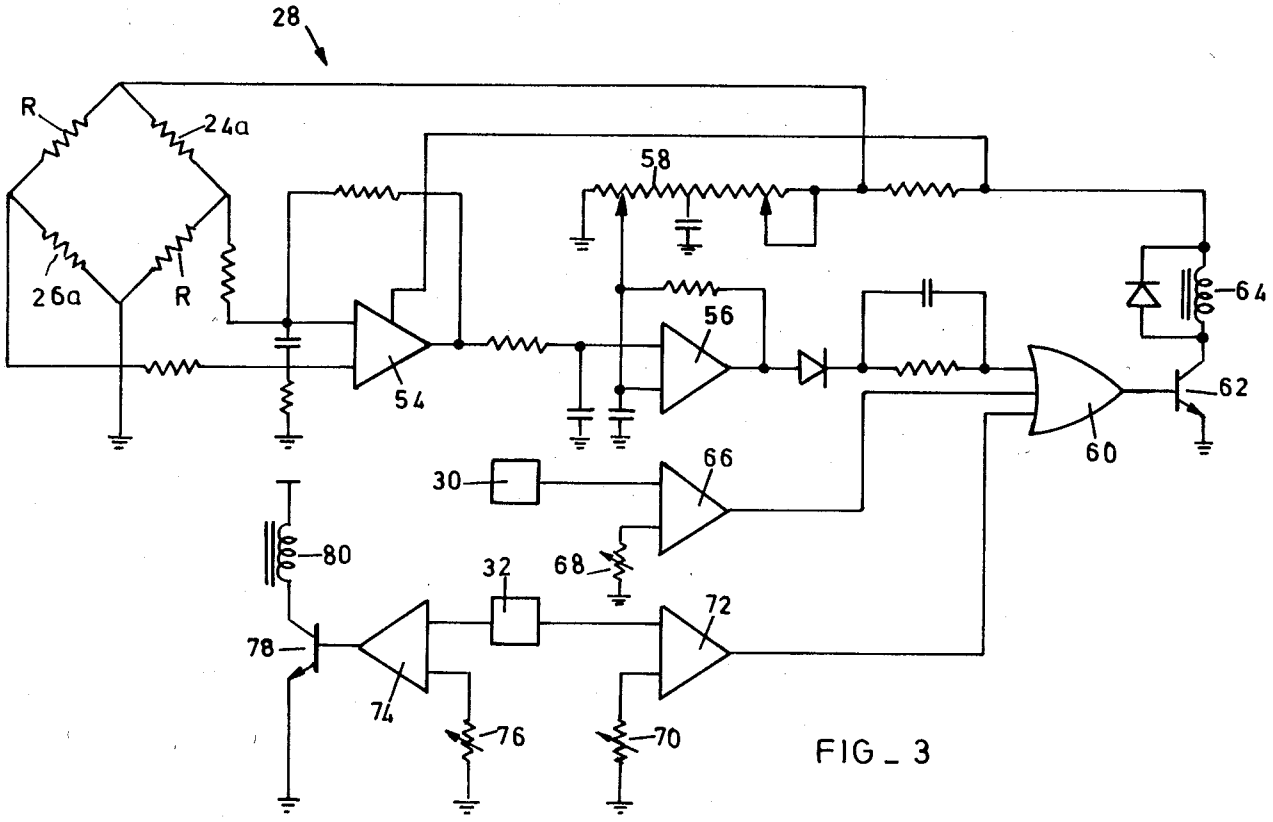
FIG. 3 is a circuit diagram of the curing apparatus of the invention.

FIG. 3 is a circuit diagram of the controller 28 shown in FIG. 1. Platinum temperature dependent resistors 24a and 26a respectively are used for the probes 24 and 26 and these are connected with resistors R a bridge configuration. The currents passed by the resistors 24a and 26a are proportional to the temperatures in the upper and lower zones in the curer and the voltages across the resistors are therefore proportional to the temperatures. The output voltage of the bridge is applied to a first comparator 54 and the output of this comparator as applied to an inverting input of a second comparator 56. The positive terminal of this comparator is connected to an adjustable voltage source 58. The output of the comparator 56 is applied to an AND gate 60 which in turn is used to control a power transistor 62 connected in series with a relay coil 64.

The dry bulb sensor 30 which also produces an output signal which is proportional to temperature is compared in a comparator 66 to an adjustable reference signal from a source 68. The output of the comparator is also applied to the AND gate 60.

Similarly the output signal of the wet bulb sensor 32 is compared to an adjustable reference signal from a source 70 in a comparator 72 and the output signal of the comparator is applied to the AND gate 60. The wet bulb signal is also applied to a second comparator 74 where it is compared to a signal from an adjustable reference source 76. The output signal of the comparator 74 drives a power transistor 78 which is connected in series with a relay coil 80.

The relay coil 64 is used to control the operation of the heat source which supplies heat to the heat exchanger 20. The coil 80 on the other hand is used to control the opening and closing of one or more of the vents 22.

Figure 4:
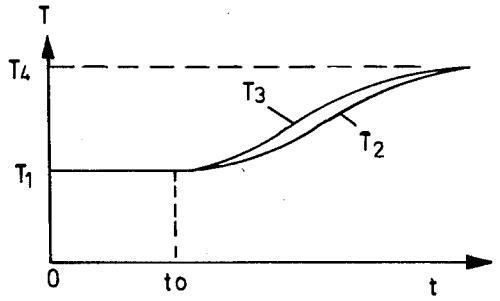
FIG. 4 is a graph of temperature versus time which is achieved in the curer of FIG. 1 by means of the invention.

FIG. 4 illustrates the relationship of temperature versus time achieved with the aid of the apparatus of the invention in the period from time=O to time=$t_o$ to which for ripe tobacco leaf is approximately 50 hours. The temperature as measured by the dry bulb sensor 30 is initially maintained at a value $T_1$ which is approximately 36° C. This is the colouring or yellowing stage and simultaneously the relative humidity of the tobacco leaf in the curer is reduced from approximately 100% to 85%. After this first stage the drying stage commences and the controller functions to maintain the difference between the temperatures $T_2$ and $T_3$ measured respectively by the sensors 24 and 26, at less than a predetermined level. This differential may be of the order of from 10° C. to 20° C. As the leaf dries the temperatures $T_2$ and $T_3$ approach a limiting value $T_4$ which is of the order of 75° C.

The apparatus functions in the following way. During the colouring stage the control function is supplied essentially by the dry and wet bulb sensors 30 and 32 via the AND gate 60. The adjustable reference source 68 is adjusted to a setting which corresponds to the temperature $T_1$ i.e. 36° C. and the reference 70 is adjusted to a setting corresponding to a wet bulb temperature of 42° C. The setting of the differential controller which is connected to the probes 24 and 26 is such that during the colouring stage its output to the AND gate is high. Since the temperature setting of the sensor 30 is lower than that of the sensor 32 the supply of heated air to the curer is determined essentially by the dry bulb sensor and is maintained at the set point of $T_1$. The wet bulb sensor 32 will under normal conditions not affect the supply of heat to the air stream for it only functions if the wet bulb temperature exceeds 42° C. This temperature is chosen as a limiting one for it is known that the tobacco leaf can be damaged if the wet bulb temperature exceeds 42° C.; this corresponding to a very high humidity level which can lead to sponginess in the leaf. Thus barring abnormal conditions the dry bulb sensor is used to control the supply of heat to the air stream.

As mentioned, during the colouring stage the relative humidity level in the curer is reduced from 100% to 85%. This is achieved during the period up to time $t_o$ by initially setting the adjustable reference source 76 to a position which corresponds to 35° C., i.e. at one degree below the reference 68, and thereafter reducing the setting to 34° C. and then to 33° C. It is known that a difference between wet bulb and dry bulb temperature sensor readings of 1° C. corresponds to a reduction in the relative humidity level of approximately 5%. Thus the control function exerted by the wet bulb sensor 32 via the comparator 74 is such that the relay coil 80 is operated, depending on the prevailing wet bulb temperature reading, and is used to control the opening and closing of the vents 22. On the one hand therefore the supply of heat to the tobacco leaf is controlled by the dry bulb sensor while on the other hand the supply of air to the leaf and consequently the prevailing relative humidity level in the curer is controlled by means of the wet bulb sensor 32.

As indicated each 1° C. reduction in the setting of the reference source 76 corresponds to a 5% reduction in relative humidity level and thus by time $t_o$ the relative humidity level is reduced to 85%. This is achieved whilst maintaining the temperature constant at $T_1$ and at the same time guarding against abnormal variations in the relative humidity level by means of the comparator 72. It should be pointed out that such abnormal variations in relative humidity can occur if there is an equipment malfunction or due to the properties of the leaf itself. If the relative humidity level does rise abnormally high it is not possible to reduce it merely by means of the vents 22 and it therefore becomes necessary to interrupt the supply of heat to the air stream.

After the colouring stage the drying stage commences. The reference source 68 is adjusted to a setting which corresponds to a dry bulb temperature of 75° C., i.e. the temperature $T_4$ shown in FIG. 4. The reference source 70 is left at a setting which corresponds to a temperature of 42° C. and initially the reference source 76 is left at the setting of 33° C. The control function therefore passes to the differential controller in the following way. The signals produced by the probes 24 and 26 are applied to the comparator 54 which goes on or off depending on the setting of the inputs to the comparator. The output signal of the comparator is compared to the voltage source 58 and depending on the relationship of these two voltages the output signal of the comparator 56 is either high or low. Since the other two inputs to the AND gate 60 are high the coil 64 is either not energised or energised respectively through the transistor 62.

When heat is called for by the control circuit the contactor of the heat source is closed and the heat source is turned on. Additional fuel is supplied to the heat source and air which is passed through the heat exchanger 21 by the fan 18 is heated to a higher temperature. The hot air is circulated through the curer by means of the fan 18 and as it rises through the curer from the false floor dries the leaf in the barn.

Water is evaporated from the leaf and taken up by the air. The temperature of the air therefore drops and a temperature differential is established between the upper and lower probes 24 and 26. If the temperature of the air in the lower zone is too high then the differential increases. The differential is dependent on the evaporation rate of the leaf and thus a high differential indicates that the drying process is too rapid. Conversely a low differential is indicative of a low evaporation rate.

The differential controller functions to maintain the temperature differential at a value which has been empirically determined as being optimal. The differential is of course inherently dependent on the humidity level in the curer and this is dependent on the moisture content of the leaf, the evaporation rate of the leaf, and the temperature of the air introduced into the lower zone.

With the passage of time the temperatures $T_2$ and $T_3$ rise progressively but with the differential controller functioning to maintain the difference between the temperatures $T_2$ and $T_3$ at less than a predetermined value. As $T_2$ and $T_3$ approach $T_4$ they also approach one another indicating that the humidity level is continuously decreasing. The drying stage is completed when $T_2$ and $T_3$ are substantially the same.

When the air temperature supplied to the curer reaches a value of approximately 50° C. the setting of the reference source 76 is set to a temperature of approximately 40° C. which is 2° C. below the setting of the source 70. Thus, as before, the sensor 32 functions via the comparator 74 and relay coil 80 to open and close the vents to control the relative humidity level. The relative humidity level is thus allowed to rise to a value which is only just below the value at which leaf damage can occur. When this lower value is reached the vents are opened to lower the humidity level. In this way a maximum drying rate is achieved. On the other hand if the vents alone are not able to reduce the humidity level and it rises to the setting of the reference source 70, indicating that a dangerous level has been reached, the heat supply to the air stream is cut off. The drying rate therefore decreases and the humidity level also drops. The heat supply is restored once the humidity level has decreased.

The temperature and humidity control function exerted by the controller 28 is highly efficient and permits a maximum curing rate while at the same time guarding against high humidity levels which can damage the leaf. The net result is a minimum curing time without spoilage and with a maximum recovery of best quality cured tobacco leaf. The reduced curing time leads in turn to the most economical consumption of fuel by the heat source.

We claim:

1. A method of curing tobacco leaf located in a curer which includes the steps of circulating an air stream through the curer, supplying heat to the air stream, controlling the heated air stream so as to maintain a first substantially constant temperature in the curer for a predetermined period, during the predetermined period reducing the relative humidity level prevailing in the curer from a first level to a second level, and, after the predetermined period, controlling the heated air stream so as to maintain a predetermined temperature differential between upper and lower zones in the curer.

2. A method according to claim 1 wherein the heated air stream is controlled by varying the rate of flow of the air stream.

3. A method according to claim 1 wherein the heated air stream is controlled by varying the supply of heat to the air stream.

4. A method according to claim 3 which includes the step of interrupting the supply of heat to the air stream when the relative humidity level exceeds a predetermined level, and restoring the supply of heat to the air stream when the relative humidity level drops below the

5. A method according to claim 1 wherein, during the predetermined period, the relative humidity level prevailing in the curer is reduced from approximately 100% to approximately 85%.

* * * * *

UNITED STATES PATENT AND TRADEMARK OFFICE

CERTIFICATE OF CORRECTION

PATENT NO. : 4,559,956

DATED : December 24, 1985

INVENTOR(S) : Jan H. De Lange et al.

It is certified that error appears in the above—identified patent and that said Letters Patent is hereby corrected as shown below:

Claim 4, last line, after "the" insert --predetermined level--.

Signed and Sealed this

Twenty-fifth Day of March 1986

[SEAL]

*Attest:*

*Attesting Officer*

DONALD J. QUIGG

*Commissioner of Patents and Trademarks*